US005984721A

United States Patent [19]

Self, Jr. et al.

[11] Patent Number: 5,984,721

[45] Date of Patent: Nov. 16, 1999

[54] PANEL MOUNT CONNECTOR WITH TWIST LOCK

[75] Inventors: Daines Milfred Self, Jr., Oak Ridge; Ralph Glenn Vestal, Lexington, both of N.C.

[73] Assignee: Whitaker Corporation, Wilmington, Del.

[21] Appl. No.: 08/833,686

[22] Filed: Apr. 8, 1997

[51] Int. Cl.[6] ..... H01R 13/73

[52] U.S. Cl. ..... 439/546

[58] Field of Search ..... 439/544–550, 439/552, 557, 562, 563, 567, 569, 571, 247, 248; 248/222.13, 222.11, 222.52

[56] References Cited

U.S. PATENT DOCUMENTS

| | | | |
|---|---|---|---|
| 3,912,355 | 10/1975 | Curado et al. . | |
| 4,029,953 | 6/1977 | Natoli | 240/8.16 |
| 4,148,542 | 4/1979 | Wood . | |
| 4,352,538 | 10/1982 | Fowler . | |
| 4,373,771 | 2/1983 | Cross et al. | 439/549 |
| 4,653,708 | 3/1987 | Rich | 248/222.52 |
| 4,761,144 | 8/1988 | Hunt, III et al. | 439/545 |
| 5,002,497 | 3/1991 | Plocek et al. | 439/248 |
| 5,407,363 | 4/1995 | Polgar et al. | 439/546 |
| 5,772,469 | 6/1998 | Polgar et al. | 439/546 |

FOREIGN PATENT DOCUMENTS

| | | |
|---|---|---|
| 36635398 A1 | 4/1988 | Germany . |
| 1 453 980 | 10/1976 | United Kingdom . |

*Primary Examiner*—Khiem Nguyen
*Attorney, Agent, or Firm*—Robert J. Kapalka

[57] ABSTRACT

A panel mount electrical connector has a flange (24) and a locking ramp (40) forward of the flange. The flange and the locking ramp are arranged to be disposed on opposite sides of a mounting panel when the connector is disposed in a cutout of the panel. The locking ramp is inclined with respect to the flange such that the panel will become captured between the locking ramp and the flange when the connector is twisted in the cutout.

7 Claims, 3 Drawing Sheets

PANEL MOUNT CONNECTOR WITH TWIST LOCK

FIELD OF THE INVENTION

The invention relates to an electrical connector which is mountable in a cutout of a mounting panel.

BACKGROUND OF THE INVENTION

An electrical connector which can be installed in a cutout of a mounting panel typically has latch arms which are engageable with the mounting panel to secure the connector in the cutout. The latch arms are formed as cantilever beams which can be resiliently deflected to release the connector from the panel. A problem with these latch arms is that they do not readily accommodate panels of different thickness. If the panel is relatively thin the connector will be loose in the panel, while if the panel is relatively thick the latch arms may not be able to grip the panel. There is a need for a panel mount connector which is better able to accommodate panels of different thickness.

Another problem relates to sealing the connector to the panel. It is common to seal the connector by using an elastomeric material in the form of a gasket between the panel and the connector. This gasket may not provide a satisfactory seal it the panel is too thick or too thin. Further, the gasket is a separate member which can be easily lost or misplaced. There is a need to seal between a connector and its mounting panel without the use of a separate seal member.

SUMMARY OF THE INVENTION

A connector which is mountable in a cutout of a panel comprises a housing having a longitudinal axis and a pair of locking ramps extending laterally from the housing. The locking ramps are axially spaced-apart and arranged to be disposed on opposite sides of the panel when the housing is disposed in the cutout. The locking ramps are non-parallel such that the ramps will cooperate to capture the panel therebetween when the housing is rotated on the axis.

In one embodiment, one of the locking ramps is a flange that extends perpendicular to the axis. The flange is continuous around the housing and is configured to engage the panel continuously around the cutout, thereby sealing the connector to the panel.

BRIEF DESCRIPTION OF THE DRAWINGS

The invention will now be described by way of example with reference to the accompanying drawings wherein.

DETAILED DESCRIPTION OF AN EMBODIMENT OF THE INVENTION

Figure 1:
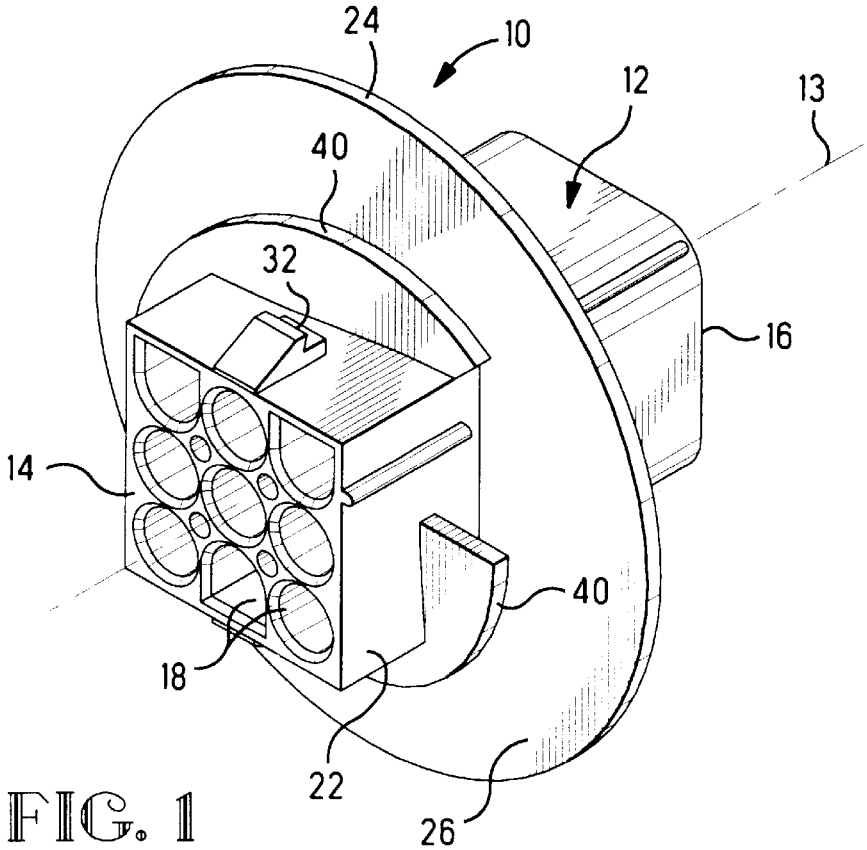
FIG. 1 is a front isometric view of a connector according to the invention.
Figure 2:
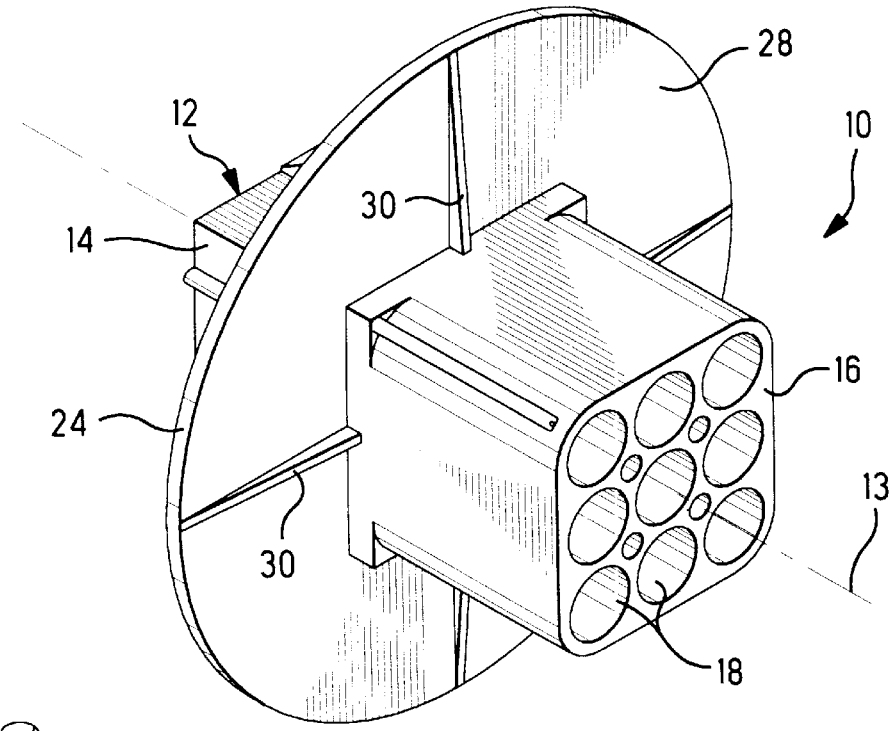
FIG. 2 is a rear isometric view of the connector.
Figure 3:
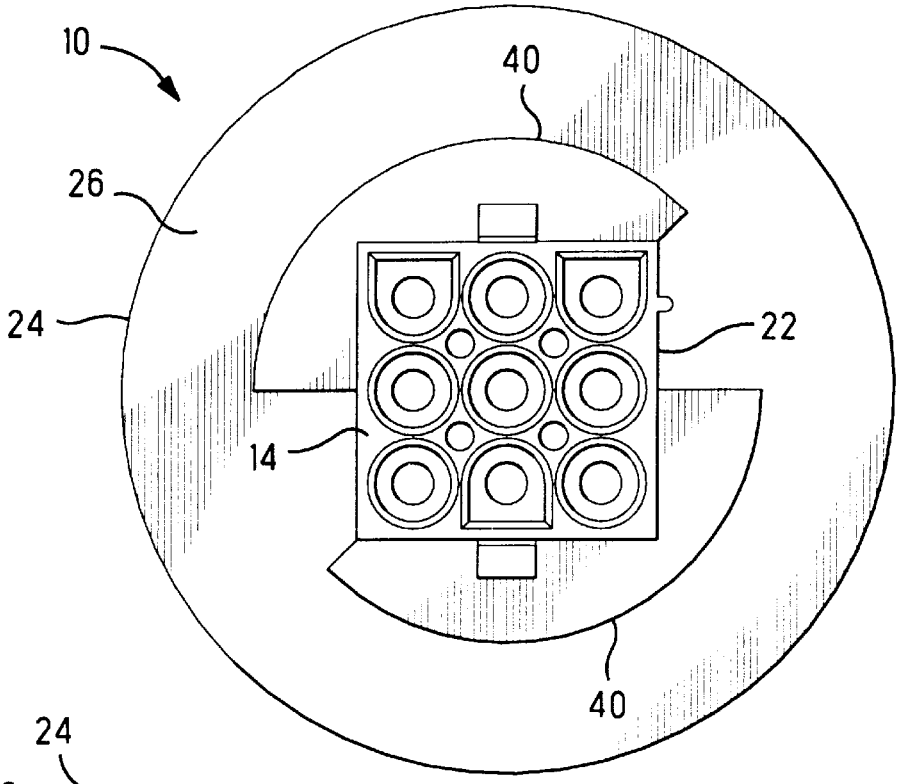
FIG. 3 is a front view of the connector.
Figure 4:
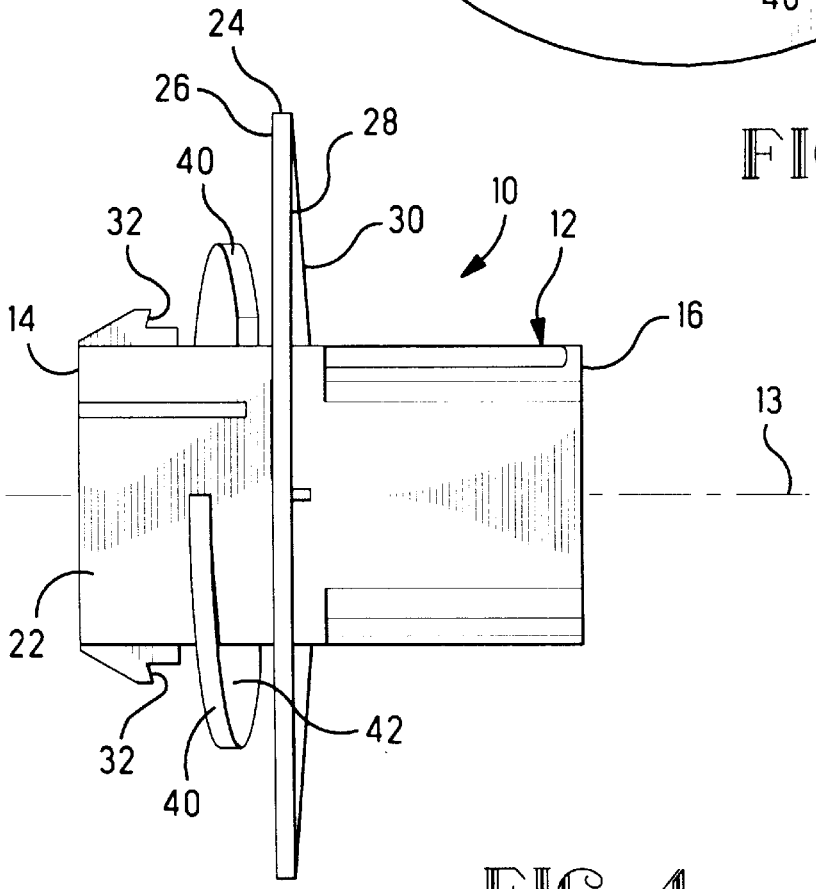
FIG. 4 is a side view of the connector.
Figure 5:
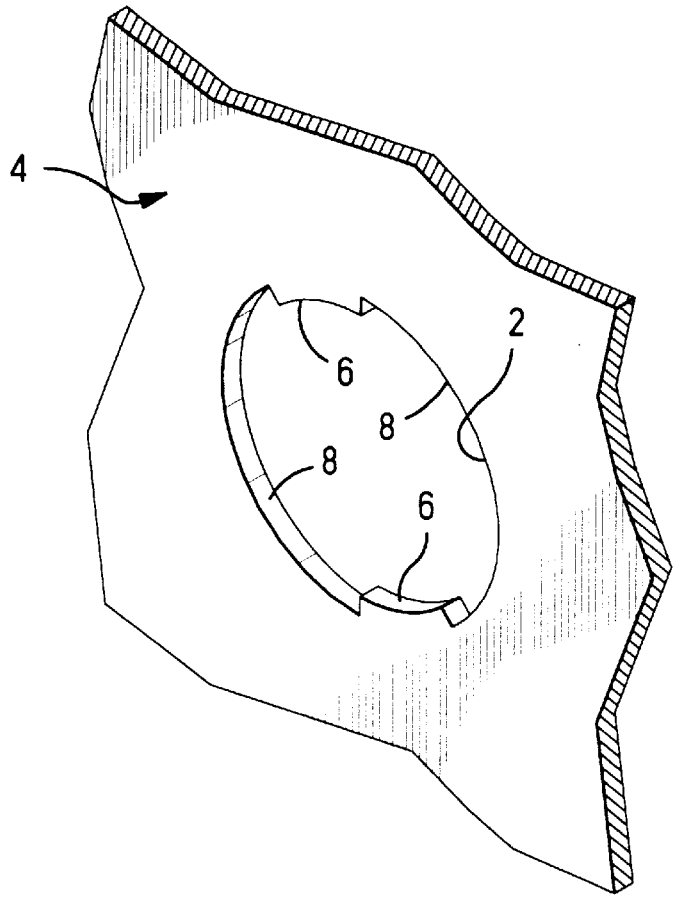
FIG. 5 is an isometric view of a mounting panel having a cutout which can receive the connector.
Figure 6:
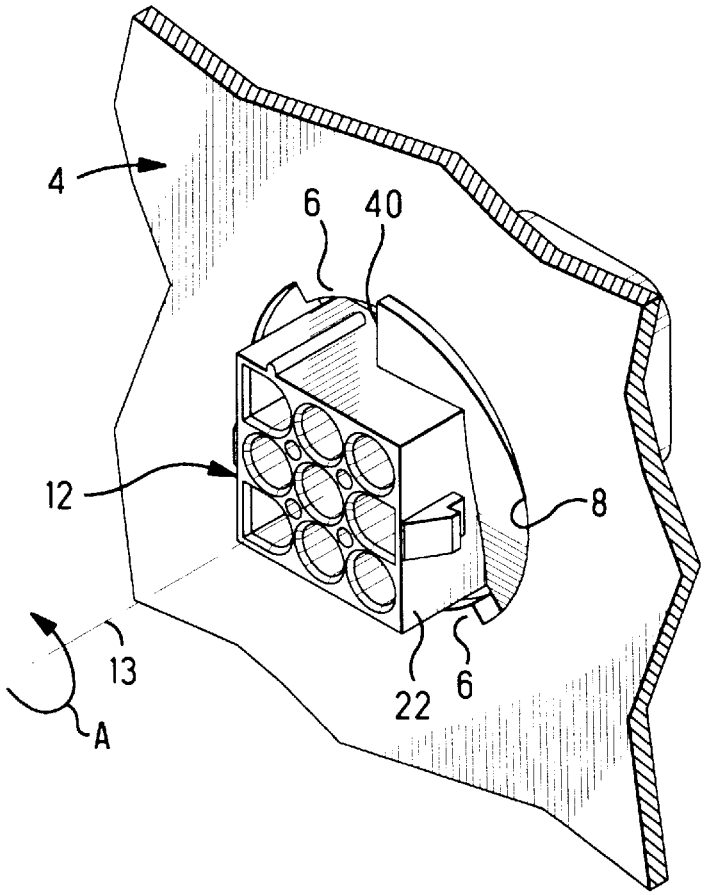
FIG. 6 is an isometric view of the connector being installed in the cutout.

There is shown in FIGS. 1–4 a panel mount electrical connector 10 comprising a dielectric housing 12 having a longitudinal axis 13, a front face 14, a rear face 16, and a plurality of cavities 18 extending through the housing between the front and rear faces. The cavities 18 are configured to hold electrical contacts which are terminated to wire conductors (not shown). The connector 10 can be installed in a cutout 2 of a mounting panel 4 (shown in FIG. 5). The housing 12 has a forward portion 22 which is insertable through the cutout, as shown in FIG. 6, and a flange 24 which extends laterally of the housing rearward of the forward portion, as shown in FIGS. 1 and 4. The forward portion 22 is matable with a mating electrical connector (not shown). The forward portion 22 has ledges 32 which are engageable by latch members of the mating electrical connector to retain the mated connectors together.

The flange 24 is dimensioned larger than the cutout 2 to prevent passage of the flange through the cutout. The flange has a front surface 26 which is engageable with the panel 4 around the cutout. Preferably, the flange is circumferentially continuous so as to completely surround the housing 12, and the flange is configured to engage the panel continuously around the cutout. A rear surface 28 of the flange has strengthening ribs 30 to resist deflection of the flange. As shown in FIG. 4, the flange preferably extends perpendicular to the longitudinal axis 13.

The connector 10 has at least one locking ramp 40 which extends laterally from the forward portion 22 of the housing and is spaced from the flange 24. The locking ramp 40 and the flange 24 are arranged to be disposed on opposite sides of the panel 4 when the connector housing 12 is installed in the cutout 2. The locking ramp 40 cooperates with the flange 24 to capture the mounting panel 4 therebetween when the housing is rotated on the axis 13. The locking ramp and the flange are not parallel. The locking ramp has a flat rear surface 42 which is inclined with respect to the front surface 26 of the flange. Due to the incline between these surfaces 26 and 42, an axial distance between the locking ramp and the flange varies at different circumferential locations therealong. The incline of the locking ramp 40 and its spacing from the flange 24 is selected so that the distance between the locking ramp and the flange will extend over a range that can accommodate panels of different thickness.

In the embodiment shown, the connector has two of the locking ramps 40 disposed on diametrically opposite sides of the housing 12 and that extend for angular distances of at least 90 and less than 180, as seen in FIG. 3, and are spaced apart sufficiently from each other to permit passage therbetween of tabs 6 of the panel (FIG. 6). The locking ramps 40 are configured for insertion through the cutout 2 in the panel 4. The cutout is defined by a substantially circular opening having a circumference that is interrupted by two diametrically opposed, inwardly projecting tabs 6. The tabs define two arcuate cutout sections 8 along the outer boundary of the cutout 2, and the locking ramps 40 are insertable through the arcuate cutout sections 8, as shown in FIG. 6. Then, by twisting or rotating the connector on its axis 13 in the direction of arrow A, the locking ramps 40 are moved in front of the tabs 6 until the tabs become wedged between opposing portions of the locking ramps 40 and the flange 24. The connector is secured to the panel by frictional resistance due to the wedging action of the tabs 6. This wedging action also urges the flange 24 into sealing engagement with the panel. Thus, the connector is both secured to the panel and sealed to the panel by a simple twisting motion during installation.

Although the connector has been shown and described as having a flange that is circumferentially continuous so as to completely surround the connector housing, it should be understood that a connector according to the invention need not have a flange that surrounds the housing. An advantage of a circumferentially continuous flange is that the flange forms a seal with the panel. However, the flange also functions as a locking ramp. Thus, a connector according to the invention could have one or more of the locking ramps 40 in place of the flange 24. Such an arrangement would not provide sealing with the panel, but would provide a twist lock. This connector would have a pair of the locking ramps 40 axially spaced apart and arranged to be disposed on opposite sides of the panel when the connector housing is disposed in the cutout. It is only necessary that this pair of locking ramps be non-parallel so that they will cooperate to capture the panel therebetween when the connector is rotated on its axis.

The invention having been disclosed, a number of variations will now become apparent to those skilled in the art. Whereas the invention is intended to encompass the foregoing preferred embodiments as well as a reasonable range of equivalents, reference should be made to the appended claims rather than the foregoing discussion of examples, in order to assess the scope of the invention in which exclusive rights are claimed.

We claim:

1. A connector which is mountable in a cutout of a panel, the connector comprising:

a housing having a longitudinal axis, a forward portion which is insertable through the cutout, a flange rearward of the forward portion and dimensioned larger than the cutout to prevent passage of the flange through the cutout, and a pair of locking ramps extending laterally from diametrically opposite sides of the forward portion and spaced from the flange, said pair of locking ramps each being inclined with respect to said panel surface and each extends an angular distance around said housing for at least 90° and less than 180°, the locking ramps being inclined with respect to the flange wherein the locking ramps cooperate with the flange to capture the panel wedgingly between opposing portions of the locking ramps and the flange when the housing is rotated on the axis.

2. The connector of claim 1 wherein the flange is continuous around the housing.

3. The connector of claim 2 wherein the flange is configured to engage the panel continuously around the cutout.

4. The connector of claim 1 wherein said housing is molded of plastics material and said first and second locking ramps are integrally molded portions thereof.

5. The connector of claim 1 wherein said pair of locking ramps are spaced apart around said housing to permit passage therebetween of tabs of said panel inwardly directed into said cutout from opposing sides thereof as said housing is being inserted through said cutout, where-after said housing is rotated to wedge said tabs between respective ones of said pair of locking ramps and opposing portions of said flange axially spaced therefrom.

6. The connector of claim 1 wherein said pair of locking ramps having flat rear surfaces facing and engageable with said panel during rotation of the housing.

7. The connector of claim 1 wherein said flange includes a plurality of strengthening ribs extending along a rearwardly facing surface thereof.

* * * * *